US005308156A

United States Patent [19]

Gutierrez

[11] Patent Number: 5,308,156

[45] Date of Patent: May 3, 1994

[54] TOOL BOX FAN, HEATER, OR BOTH

[76] Inventor: Robert R. Gutierrez, 17750 E. Lone Oak Rd., Sanger, Calif. 93657

[21] Appl. No.: 790,830

[22] Filed: Nov. 12, 1991

[51] Int. Cl.[5] ..... A47B 83/00

[52] U.S. Cl. ..... 312/236; 454/184

[58] Field of Search ..... 454/184, 341; 312/236, 312/213, 237

[56] References Cited

U.S. PATENT DOCUMENTS 4,457,140 7/1984 Rastelli ..... 312/236

*Primary Examiner*—Kenneth J. Dorner
*Assistant Examiner*—Gerald A. Anderson
*Attorney, Agent, or Firm*—Leon Gilden

[57] ABSTRACT

A tool box cabinet including a front wall, including a cavity directed interiorly of the front wall into the cabinet mounting a fan, heater or both assembly. The fan/-heater or both assembly is arranged for selective mounting about the tool cabinet or positioned within the cavity, with the fan/heater or both assembly including a plurality of mounting legs permitting positioning of the heater assembly to the cabinet in a variety of orientations thereof. The organization further includes a directional conduit mounted to the fan/heater or both assembly for directing cooled air or heated air onto an individual directly, as well as an inlet conduit for directing air relative to an individual for selective cooling or heating relative to the fan or heater assembly.

5 Claims, 4 Drawing Sheets

TOOL BOX FAN, HEATER, OR BOTH

BACKGROUND OF THE INVENTION

1. Field of the Invention

The field of invention relates to tool box apparatus, and more particularly pertains to a new and improved tool box heater or both wherein the same utilizes a fan or heater in association with a tool box for permitting cooling or heating of a mechanic's environment in use of the tool box structure.

2. Description of the Prior Art

Mechanical work is frequently effected in environments at temperatures requiring cooling or heating for comfort of an individual. The organization provides a tool cabinet structure utilizing an associated fan/heater or both assembly to permit selective cooling or heating of an environment relative to an individual for ease of comfort in use of the organization. Examples of prior art tool cabinet structure is exemplified in U.S. Pat. No. 4,288,134 to Knaack, et al. providing for a tool box structure utilizing a reinforcing type lid organization.

U.S. Pat. No. 4,775,199 to Lanius, et al. sets forth a tool box utilizing a specific interlocking relationship of the drawers.

U.S. Pat. No. 4,483,573 to Keller utilizes a tool storage cabinet with a tool top arranged for mounting of a power saw thereon.

U.S. Pat. No. 4,531,645 to Tisbo, et al. sets forth a portable storage console to contain a variety of components therewithin, such as tools, workpieces, and the like.

As such, it may be appreciated that there continues to be a need for a new and improved tool box fan/heater or both as set forth by the instant invention which addresses both the problems of ease of use as well as effectiveness in construction including a fan/heater or both assembly for environmentally cooling or heating a surrounding area relative to an operator utilizing the tools and in this respect, the present invention substantially fulfills this need.

SUMMARY OF THE INVENTION

In view of the foregoing disadvantages inherent in the known types of tool box apparatus now present in the prior art, the present invention provides a tool box fan/heater or both wherein the same utilizes a fan/-heater or both in association with a tool box cabinet. As such, the general purpose of the present invention, which will be described subsequently in greater detail, is to provide a new and improved tool box fan/heater or both which has all the advantages of the prior art tool box apparatus and none of the disadvantages.

To attain this, the present invention provides a tool box cabinet including a front wall, including a cavity directed interiorly of the front wall into the cabinet mounting a fan/heater or both assembly. The fan/-heater or both assembly is arranged for selective mounting about the tool cabinet or positioned within the cavity, with the fan/heater or both assembly including a plurality of mounting legs permitting positioning of the fan/heater or both assembly to the cabinet in a variety of orientations thereof. The organization further includes a directional conduit mounted to the fan/heater or both assembly for directing cooled or heated air onto an individual directly, as well as an inlet conduit for directing air relative to an individual for selective cooling or heating relative to the fan or heater assembly.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tool box fan/heater or both which has all the advantages of the prior art tool box apparatus and none of the disadvantages.

It is another object of the present invention to provide a new and improved tool box fan/heater or both which may be easily and efficiently manufactured and marketed.

It is a further object of the present invention to provide a new and improved tool box fan/heater or both which is of a durable and reliable construction.

An even further object of the present invention is to provide a new and improved tool box fan/heater or both which is susceptible of a low cost of manufacture with regard to both materials and labor, and which accordingly is then susceptible of low prices of sale to the consuming public, thereby making such tool box fan/heater or both economically available to the buying public.

Still yet another object of the present invention is to provide a new and improved tool box fan/heater or both which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
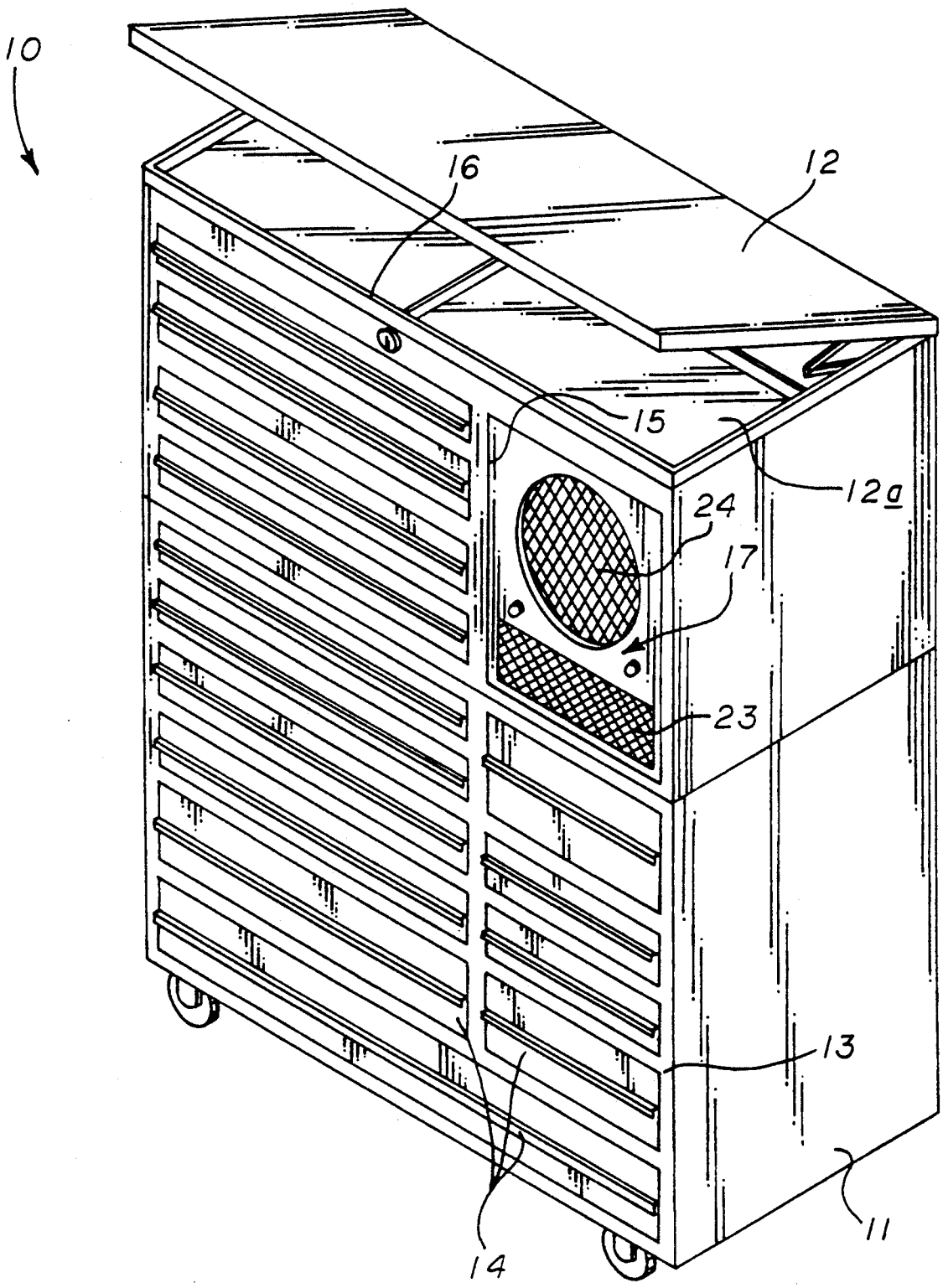
FIG. 1 is an isometric illustration of the instant invention.
Figure 2:
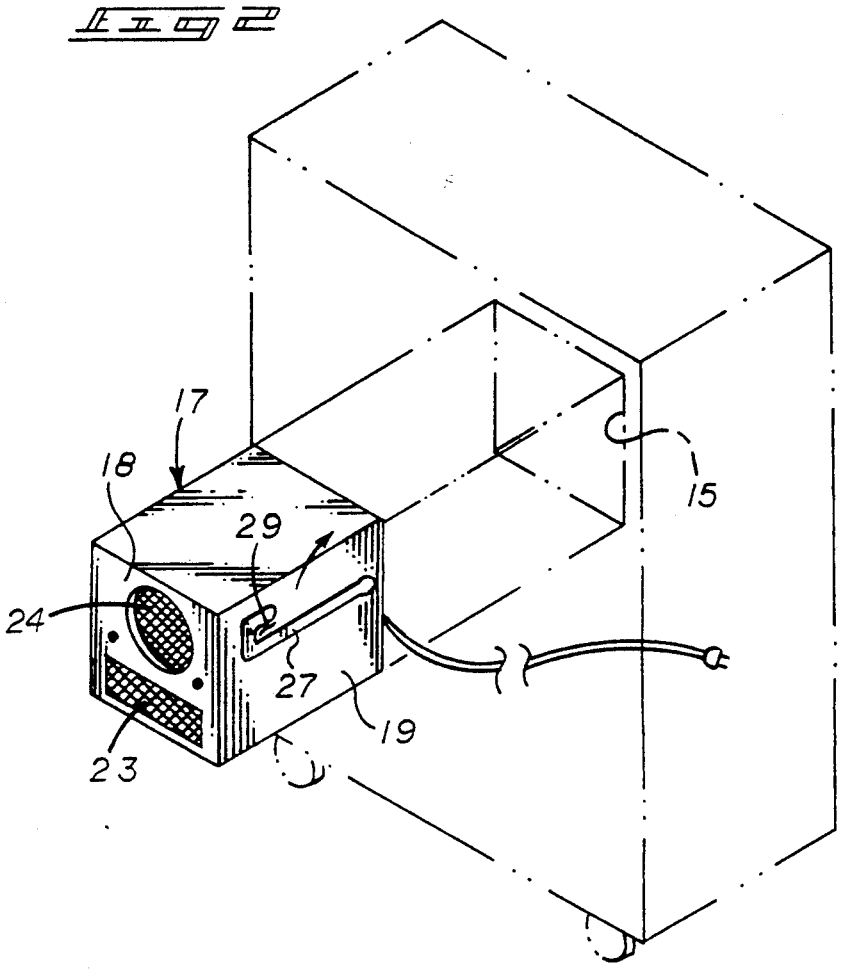
FIG. 2 is an isometric illustration of the invention illustrating the fan/heater or both assembly removable therefrom.

With reference now to the drawings, and in particular to FIGS. 1 to 7 thereof, a new and improved tool box fan/heater or both embodying the principles and concepts of the present invention and generally designated by the reference numeral 10 will be described.

Figure 3:
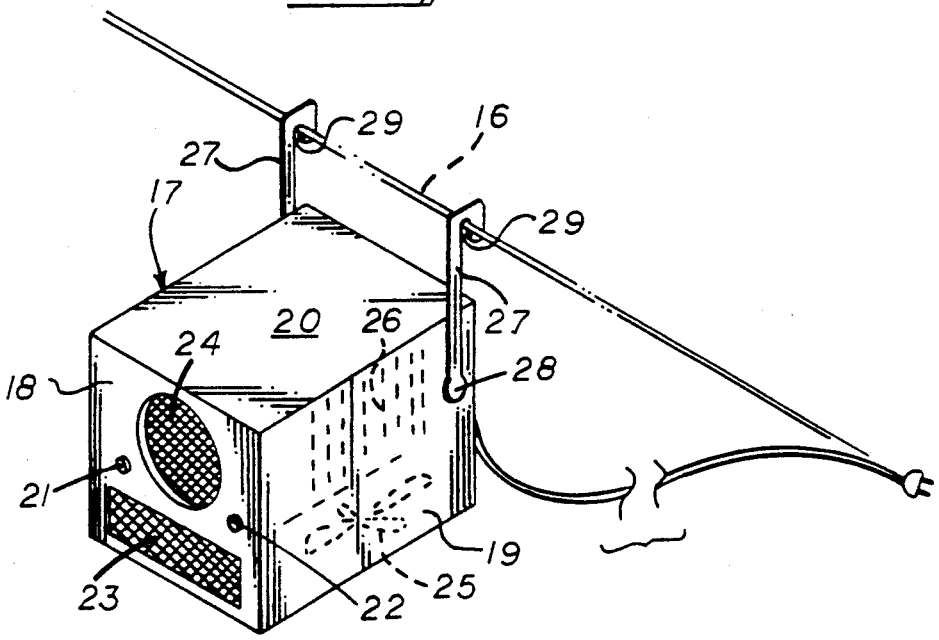
FIG. 3 is an isometric illustration of the invention illustrating its mounting relative to the tool box structure.
Figure 4:
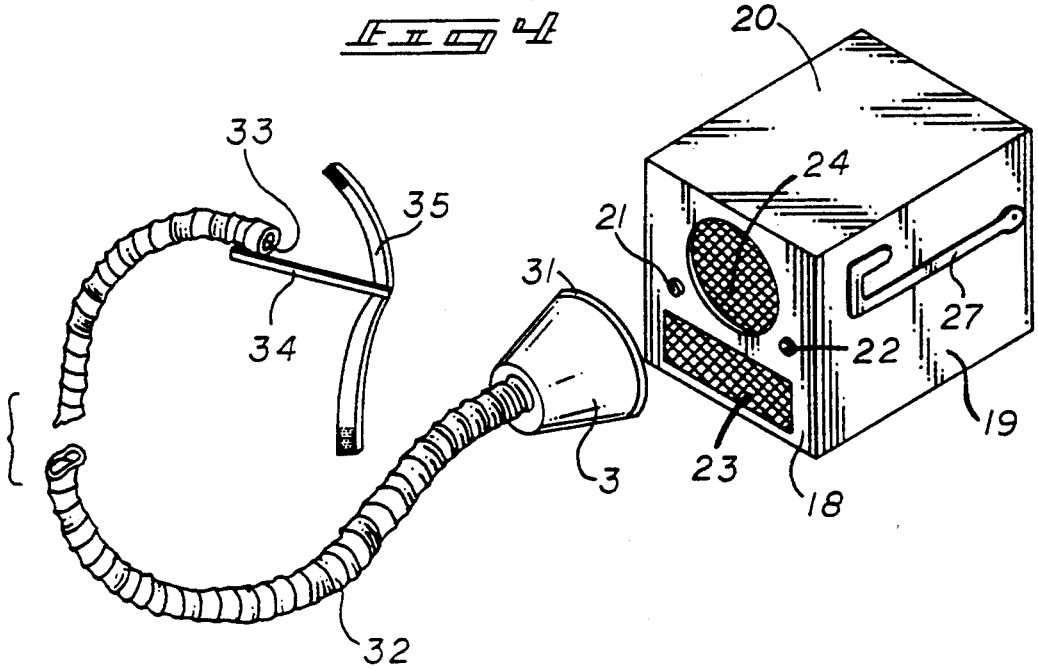
FIG. 4 is an isometric illustration of the invention utilizing a directional outlet conduit.
Figure 5:
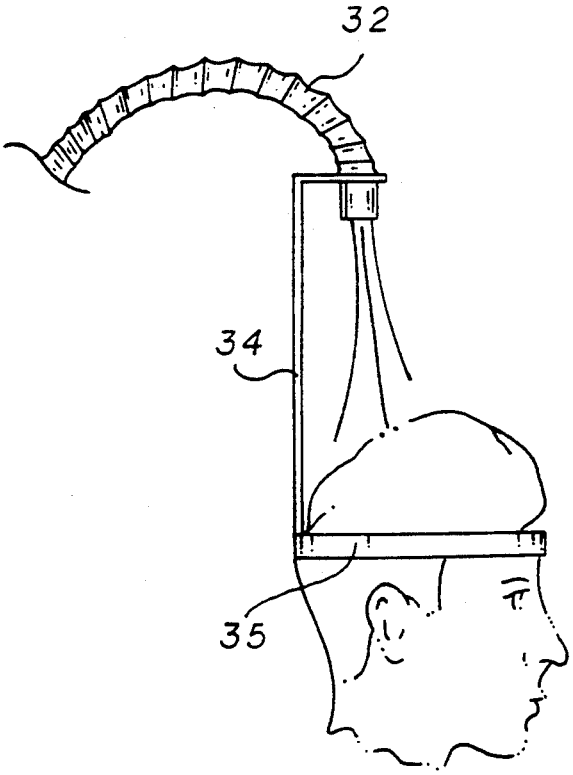
FIG. 5 is an orthographic side view of the outlet conduit in association with an operator.

More specifically, the tool box fan/heater or both apparatus 10 of the instant invention essentially comprises a tool cabinet including side walls 11, a top lid 12, a tray 12*a* underlying the top lid 12, with the tray defining a tray flange 16. The front wall 13 of the cabinet structure includes a plurality of slide drawers 14 retractably mounted from within the front wall from interiorly of the tool cabinet. The fan/heater or both cavity 15 is directed interiorly of the cabinet extending from the front wall 13 thereof. The fan/heater or both cavity 15 removably mounts a fan/heater or both housing 17 within the fan/heater or both cavity 15. The fan/heater or both housing 17 includes a housing front wall 18, housing side walls 19, and a housing top wall 20, with electrical line directed interiorly of the housing to effect electrical heating of a resistance coil grid 26 mounted within the fan/heater or both housing 17, wherein a fan 25 positioned underlying the grid 26 directs air from an heater outlet 23 through the housing front wall 18, through the resistance coil grid 26, and subsequently through the fan outlet 24 through the front wall 18. An on/off switch 21 and a rheostat control 22 are provided to effect selective operation of the heater and resistance coil grid, in a manner conventionally known to those of ordinary skill in the art. A plurality of support legs 27 are provided, with a support leg 27 pivotally mounted to each housing side wall 19 about a pivot axle 28. An upper terminal end of each support leg defines a support leg slot 29 for mounting upon the tray flange 16, as illustrated in FIG. 3, or about an upper edge of an associated drawer in a like manner to permit orientation of the fan/heater or both housing as desired relative to an individual utilizing the organization.

The air outlet screen 24 is defined by a predetermined diameter, wherein the apparatus further includes a flexible conduit 32, including a funnel conduit 30 mounted at a first terminal end thereof defined by the predetermined diameter, with the funnel conduit's outer rim defined by the predetermined diameter, including a first magnetic rim 31 for magnetically adhering the funnel conduit 30 to the ferrous metallic fan/heater or both housing front wall 18 in surrounding relationship relative to the air outlet screen 24. The conduit 32 includes a conduit outlet 33, with a support rod 34 of rigid construction mounted to the outlet 33, with the support rod 34 including a mounting strap 35 for securement about an individual, in a manner as exemplified in FIG. 5, to direct cooled or heated air onto the individual. The mounting strap 35 includes fastening structure, such as hook and loop fasteners, as illustrated, for permitting securement of the free terminal ends of the mounting strap about the individual.

Figure 6:
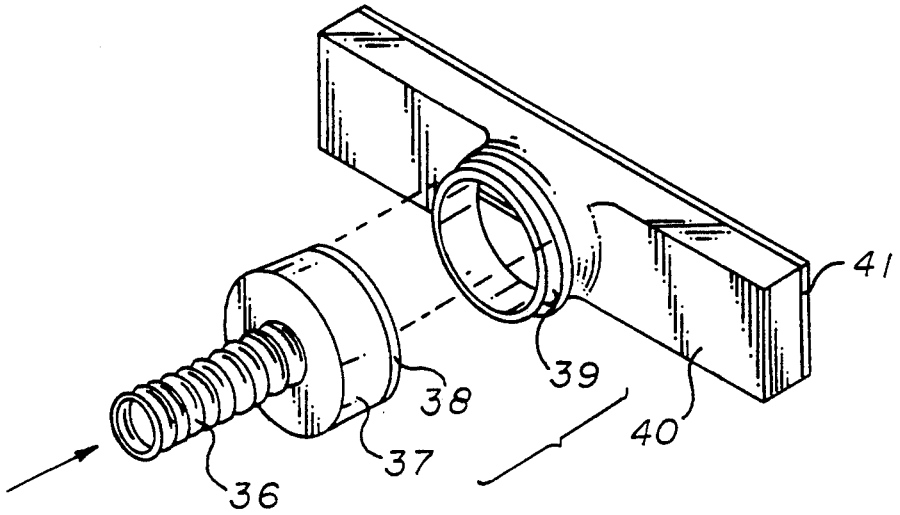
FIG. 6 is an isometric illustration of an inlet conduit structure utilized by the invention.
Figure 7:
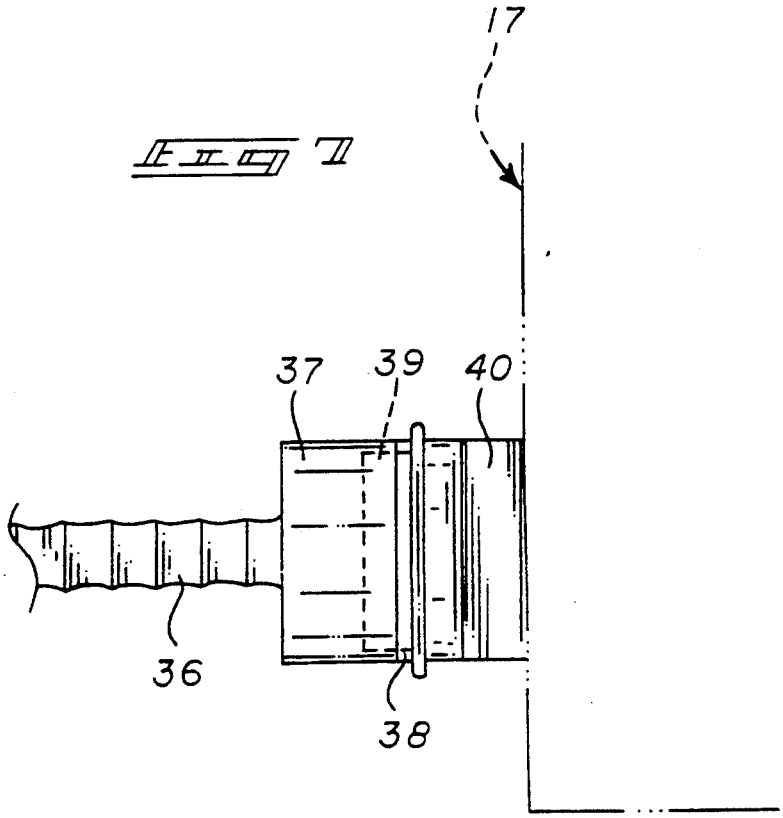
FIG. 7 is an orthographic side view of the inlet conduit mounted to the fan/heater or both assembly.

FIGS. 6 and 7 illustrate the use of the apparatus of a directional inlet hose 36 that includes an inlet hose cap 37. The inlet hose cap 37 includes a second magnetic rim 38 mounted to a free terminal end thereof for securement to a ferrous metallic collar 39 that is fixedly and integrally mounted to an inlet housing 40. The inlet housing 40 is arranged for surrounding securement to the fan/heater or both housing front wall 17 about the inlet screen 23 by use of a third magnetic rim 41.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tool box and heater apparatus, comprising, a tool cabinet, including spaced side walls, a front wall, and a top lid, and a tray mounted within the cabinet underlying the top lid, the tray including a tray flange extending upwardly about the tray, and a heater housing oriented within the tool cabinet directed interiorly thereof extending from the front wall, and the heater housing slidably and removably mounted relative to the heater housing cavity, the heater housing including a housing front wall, housing side walls, and a housing top wall, and the heater housing including an air inlet screen, and an air outlet screen directed through the front wall, the air outlet screen defined by a predetermined diameter, and each side wall of said housing side walls including a support leg, and said support leg includes a pivot axle pivotally mounting each support leg at a lower terminal end of each support leg into a side wall of said housing side walls, and each upper terminal end of each support leg including a support leg slot, the support leg slot arranged for receiving the tray flange therewithin for mounting the heater housing selectively about the tool cabinet.

2. An apparatus as set forth in claim 1 including a flexible conduit, the flexible conduit including a funnel conduit mounted at a first terminal end of the flexible conduit, the funnel conduit including a magnetic rim, the magnetic rim defined by a rim diameter equal to the predetermined diameter, and wherein the housing front wall is formed of a ferrous metallic material to permit selective magnetic securement of the magnetic rim to the housing front wall in surrounding relationship relative to the outlet screen.

3. An apparatus as set forth in claim 2 wherein the flexible conduit includes a conduit outlet, the conduit outlet includes a rigid support rod mounted to the conduit outlet, the support rod including a mounting strap, the mounting strap formed of a flexible material, including fastener members at each terminal end of the mounting strap for permitting securement of the mounting strap and support rod to an individual directing the conduit outlet to the individual.

4. An apparatus as set forth in claim 3 including an inlet hose, the inlet hose including an inlet hose cap, the inlet hose cap including a further magnetic rim, and an inlet housing, the inlet housing arranged for surrounding relationship relative to the inlet screen, and the inlet housing including a housing rim, the housing rim formed of a magnetic material permitting magnetic securement of the inlet housing to the front wall in surrounding relationship relative to the inlet screen.

5. An apparatus as set forth in claim 4 wherein the inlet housing includes a ferrous metallic collar, the ferrous metallic collar arranged for magnetically receiving the further magnetic rim of the inlet hose cap for permitting directional air directed into the inlet screen.

* * * * *